US010934713B2

(12) United States Patent
Gavin

(10) Patent No.: US 10,934,713 B2
(45) Date of Patent: Mar. 2, 2021

(54) CLIPPING APPARATUS FOR CONNECTION OF REBAR

(71) Applicant: Peter W. Gavin, Durham, CT (US)

(72) Inventor: Peter W. Gavin, Durham, CT (US)

(73) Assignee: Polylok, Inc., Wallingford, CT (US)

( * ) Notice: Subject to any disclaimer, the term of this patent is extended or adjusted under 35 U.S.C. 154(b) by 0 days.

(21) Appl. No.: 15/973,224

(22) Filed: May 7, 2018

(65) Prior Publication Data

US 2019/0338524 A1 Nov. 7, 2019

(51) Int. Cl.
*E04C 5/16* (2006.01)

(52) U.S. Cl.
CPC ..... *E04C 5/167* (2013.01); *E04C 5/166* (2013.01); *E04C 5/168* (2013.01)

(58) Field of Classification Search
CPC ..... E04C 5/167; E04C 5/168; E04C 5/166
See application file for complete search history.

(56) References Cited

U.S. PATENT DOCUMENTS 4,110,951 A * 9/1978 Padrun ..... E04C 5/168 403/395
5,509,636 A * 4/1996 Cotugno ..... E04C 5/167 24/336
6,758,021 B1 7/2004 Trangsrud
6,910,309 B2 6/2005 Trangsrud
D548,053 S 8/2007 Erickson et al.
D608,182 S 1/2010 Banks
2006/0059850 A1* 3/2006 Minor ..... E04C 5/167 249/219.1
2010/0043337 A1* 2/2010 Banks ..... E04C 5/167 52/649.8
2012/0233956 A1* 9/2012 Fey ..... E04C 5/20 52/677
2018/0355614 A1* 12/2018 Evans ..... E04C 5/167

OTHER PUBLICATIONS

Eagle Eye Products, Inc.,www.eagleeyeproducts.com/pyramids.
Hawkeye Pedershaab, www.hawkeyepershaab.com/reinforcement-spacers/non-corrosive-spacers/.
Hawkeye Pedershaab Concrete Technologies Worldwide, Spacers & Reinforcement Accessories.
Royal Ready Mix, www.royalenterprises.net/inside-drops-special-accessories/spacelock-spacers/.
Strike Products, www.striketool.com/spacers.

* cited by examiner

*Primary Examiner* — Basil S Katcheves
*Assistant Examiner* — Omar F Hijaz
(74) *Attorney, Agent, or Firm* — Murtha Cullina LLP; Anthony P. Gangemi

(57) ABSTRACT

A clipping apparatus for holding rebar is disclosed. The clipping apparatus includes having a first base portion and a second base portion. Extensions and clips are positioned in the base portions to hold one or more rebar rods or wires in a stable orientation. Platforms are positioned to give a user a plane upon which to apply an engaging force to clip the rebar into the clipping apparatus. A chair arrangement is positioned to provide spacing between adjacent planes of rebar. A fluid-stop section is positioned about the first base portion and the second base portion. The fluid-stop section also includes a raised rim. Together with the base, platforms, and chair, the fluid-stop section to help prevent flow of liquid through the clipping apparatus.

17 Claims, 4 Drawing Sheets

CLIPPING APPARATUS FOR CONNECTION OF REBAR

BACKGROUND

Rebar rods and wire are notoriously cumbersome to manipulate, particularly by one or few individuals. In use, multiple rebar rods and/or wires are assembled together in an ordered lattice to provide support for a structure, such as a concrete wall. However, the length of rebar makes this assembly awkward and, as the lattice grows, quite strenuous and ungainly.

In an effort to stabilize the lattice during construction or pouring of the structure, clips and binders have been used to hold multiple rebar rods/wires together at one location while other portions of the lattice are constructed at another location. However, existing clips and binders are typically difficult to use, resulting in fumbling by and frustration for the user. Further, existing clips typically need to be sold in a plurality of sizes, because each clip can only hold one size of rebar. These clips also do little to prevent flow therethrough, which increases corrosion of the rebar and shortens operational lifetimes.

SUMMARY

Aspects of the present disclosure include methods and systems for a clipping apparatus for holding rebar rods and/or wires. In some embodiments, the clipping apparatus includes a base having a first base portion with a first end and a second end, and a second base portion with a third end and a forth end. In some embodiments, a first extension is positioned on the first end and a second extension is positioned on the second end. In some embodiments, each of the extensions define a notch.

In some embodiments, the clipping apparatus includes a first clip positioned on the third end and a second clip positioned on the forth end. In some embodiments, the clips include overlapping protruding portions which define a recess. In some embodiments, platforms are positioned adjacent the first clip and the second clip to transmit an engaging force applied by a user substantially parallel to the clips.

In some embodiments, the clipping apparatus includes a chair positioned on the base. In some embodiments, the clipping apparatus includes a fluid-stop section connecting the first base portion and the second base portion along an outside edge, and extending from the first base portion, the second base portion, and an intersection of the first base portion and the second base portion. In some embodiments, the fluid-stop section includes a raised rim.

BRIEF DESCRIPTION OF THE DRAWINGS

The drawings show embodiments of the present disclosure for the purpose of illustrating the invention. However, it should be understood that the present application is not limited to the precise arrangements and instrumentalities shown in the drawings, wherein.

DESCRIPTION

Figure 1A:
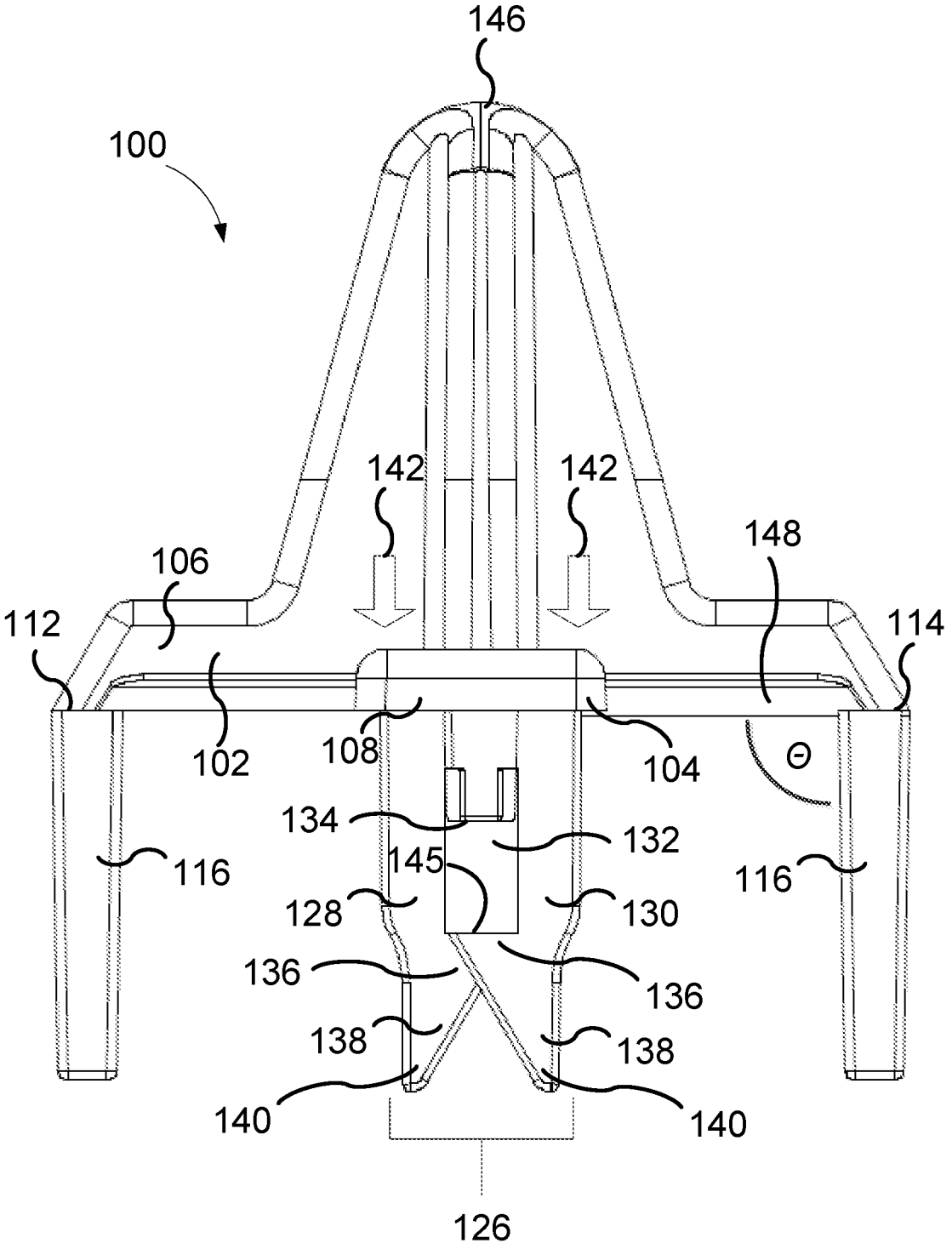
FIG. 1A is a schematic drawing of a rebar clipping apparatus according to some embodiments of the present disclosure.
Figure 1B:
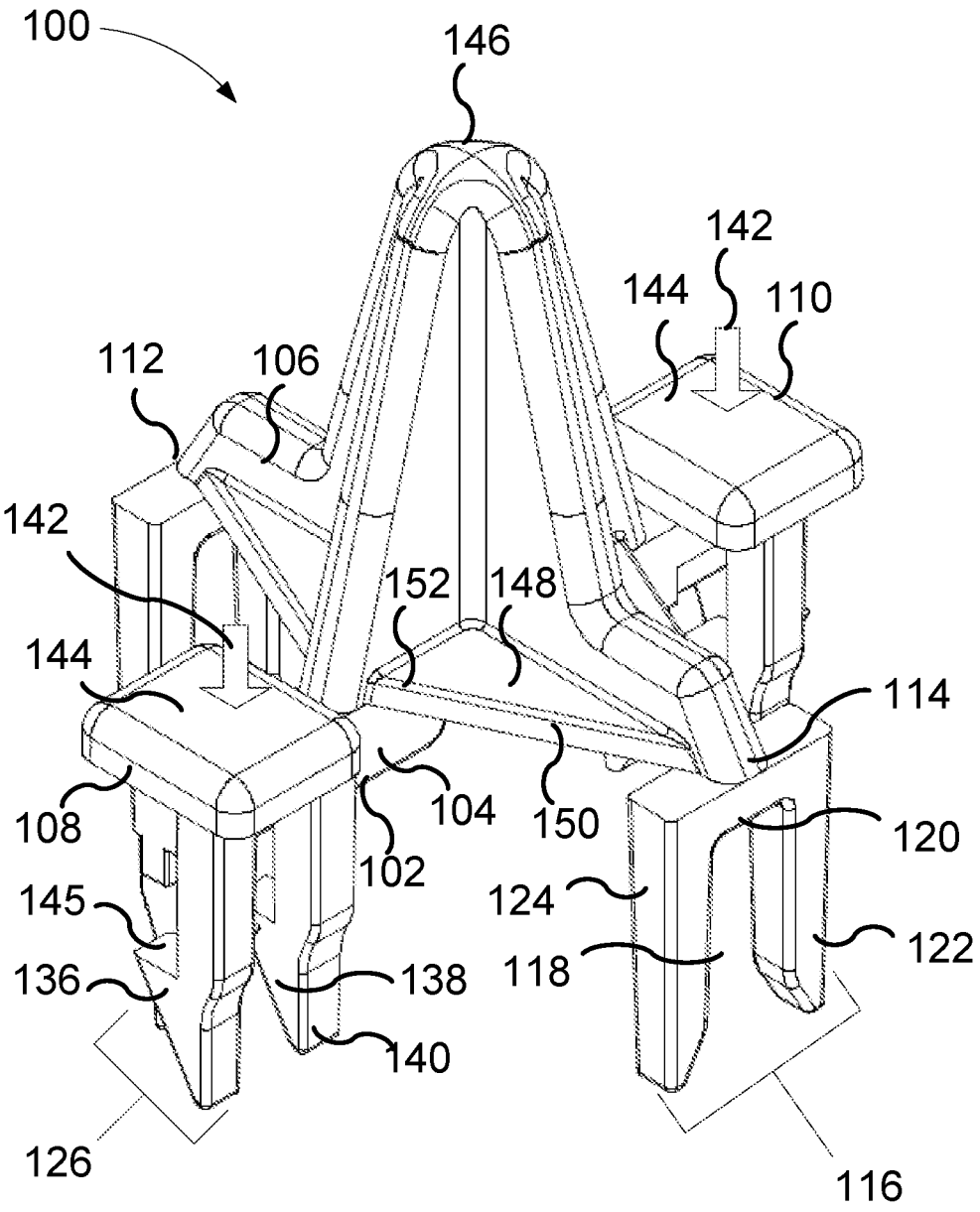
FIG. 1B is a schematic drawing of a rebar clipping apparatus according to some embodiments of the present disclosure.
Figure 1C:
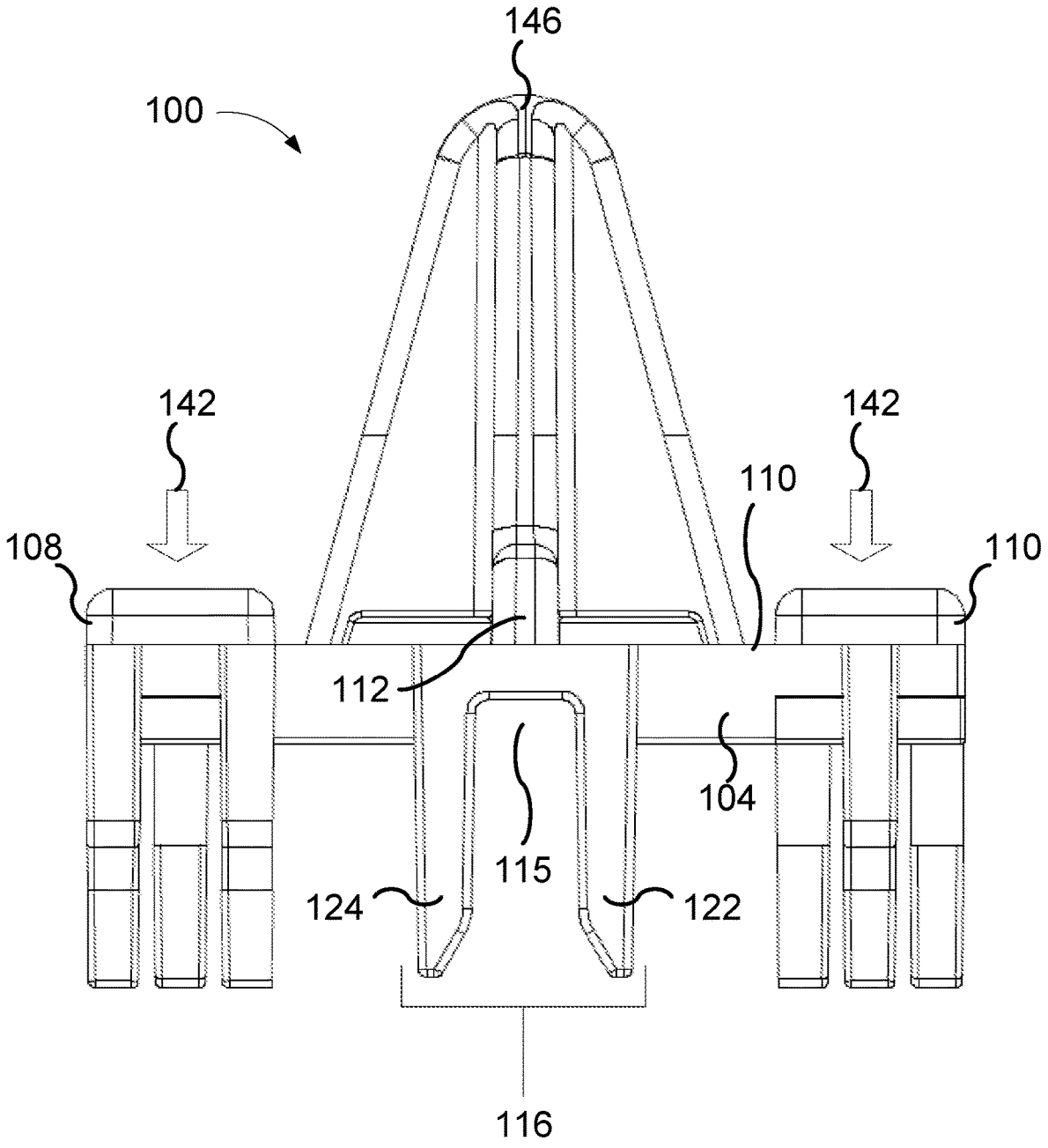
FIG. 1C is a schematic drawing of a rebar clipping apparatus according to some embodiments of the present disclosure.

Referring now to FIGS. 1A and 1B, in some embodiments, the present disclosure is directed to a clipping apparatus 100 for holding rebar. In some embodiments, clipping apparatus 100 includes a base 102. In some embodiments, base 102 includes multiple base portions. In some embodiments, base 102 includes a first base portion 104 and a second base portion 106. First base portion 104 includes a first end 108 and a second end 110. Second base portion 106 includes a third end 112 and a fourth end 114. In some embodiments, first base portion 104 and second base portion 106 have a substantially perpendicular arrangement. In some embodiments, first base portion 104 and second base portion 106 are not perpendicular. Referring now to FIG. 1C, in some embodiments, a gap 115 is included in at least one of base portions 104 and 106 to allow additional space for two rebar rods to be held together by clipping apparatus 100. In the embodiment shown in FIG. 1C, gap 115 is included in first base portion 104. However, those having skill in the art will understand that gap 115 may also be positioned in second base portion 106, or in both first base portion 104 and second base portion 106.

Referring again to FIGS. 1A and 1B, in some embodiments, extensions 116 are positioned on base 102. Extensions 116 are configured with a notch 118 to accept a rebar rod. In some embodiments, gap 115 is coaxial with notch 118. In some embodiments, notch 118 has a notch base 120. In some embodiments, extensions 116 are positioned at ends of the base portions, such as at first end 108, second end 110, third end 112, or fourth end 114. In some embodiments, a plurality of extensions 116 are positioned on the same base portion. In some embodiments, extensions 116 are positioned on multiple base portions. In some embodiments, extensions 116 are positioned at an oblique angle $\Theta$ relative to base 102. In some embodiments, oblique angle $\Theta$ is less than 180°. In some embodiments, extensions 116 include a first extension arm 122 and an opposing second extension arm 124. In some embodiments, additional extension arms may be provided to provide additional points of stabilizing contact between clipping apparatus 100 and a target rebar rod/wire. In some embodiments, the rebar rod is stabilized via interactions with the extension arms 122 and 124 and notch base 120.

In some embodiments, clips 126 are positioned on base 102. In some embodiments, clips 126 are positioned at ends of the base portions, such as at first end 108, second end 110, third end 112, or fourth end 114. In some embodiments, a plurality of clips 126 are positioned on the same base portion. In some embodiments, clips 126 are positioned on multiple base portions. In some embodiments, clips 126 include a first clip arm 128 and an opposing second clip arm 130. In some embodiments, additional clip arms may be provided to provide additional points of stabilizing contact between clipping apparatus 100 and a target rebar rod/wire. In some embodiments, first clip arm 128 and second clip arm 130 define a recess 132. In some embodiments, recess 132 includes a recess base 134. In some embodiments, recess base 134 and notch base 120 are non-co-planar.

In some embodiments, first clip arm 128 and/or second clip arm 130 include protruding portions 136. In some embodiments, protruding portions 136 define recess 132 between the protruding portions and base 102. In some embodiments, protruding portions 136 overlap. In some embodiments, protruding portions 136 include tapered portions 138. In some embodiments, tapered portions 138 are tapered ends 140.

In some embodiments, tapered ends 140 are configured to guide a rebar rod toward recess 132 upon application of an engaging force 142. In some embodiments, clipping apparatus 100 includes platforms 144 by clip 126. In some embodiments, platforms 144 are positioned and configured to transmit engaging force 142 to help engage a rebar rod. In some embodiments, engaging force 142 is transmitted substantially parallel to clip 126. In some embodiments, platforms 144 are adjacent clips 126. As the rebar rod is guided towards recess 132, clip arms 128 and 130 deflect. In some embodiments, the rebar rod is stabilized via interactions with the clip arms 128 and 130 and recess base 134. In some embodiments, the rebar rod is stabilized via interactions with protruding portions 136. In some embodiments, the rebar rod is stabilized via interactions with protruding portion faces 145. In some embodiments, the clipping of rebar into clipping apparatus 100 is reversible.

In some embodiments, a chair 146 is positioned on base 102. In some embodiments, chair 146 extends from first base portion 104. In some embodiments, chair 146 extends from second base portion 106. In some embodiments, chair 146 extends from both first base portion 104 and second base portion 106. In some embodiments, chair 146 extends in a direction opposite that of extensions 116 and/or clips 126.

Figure 1D:
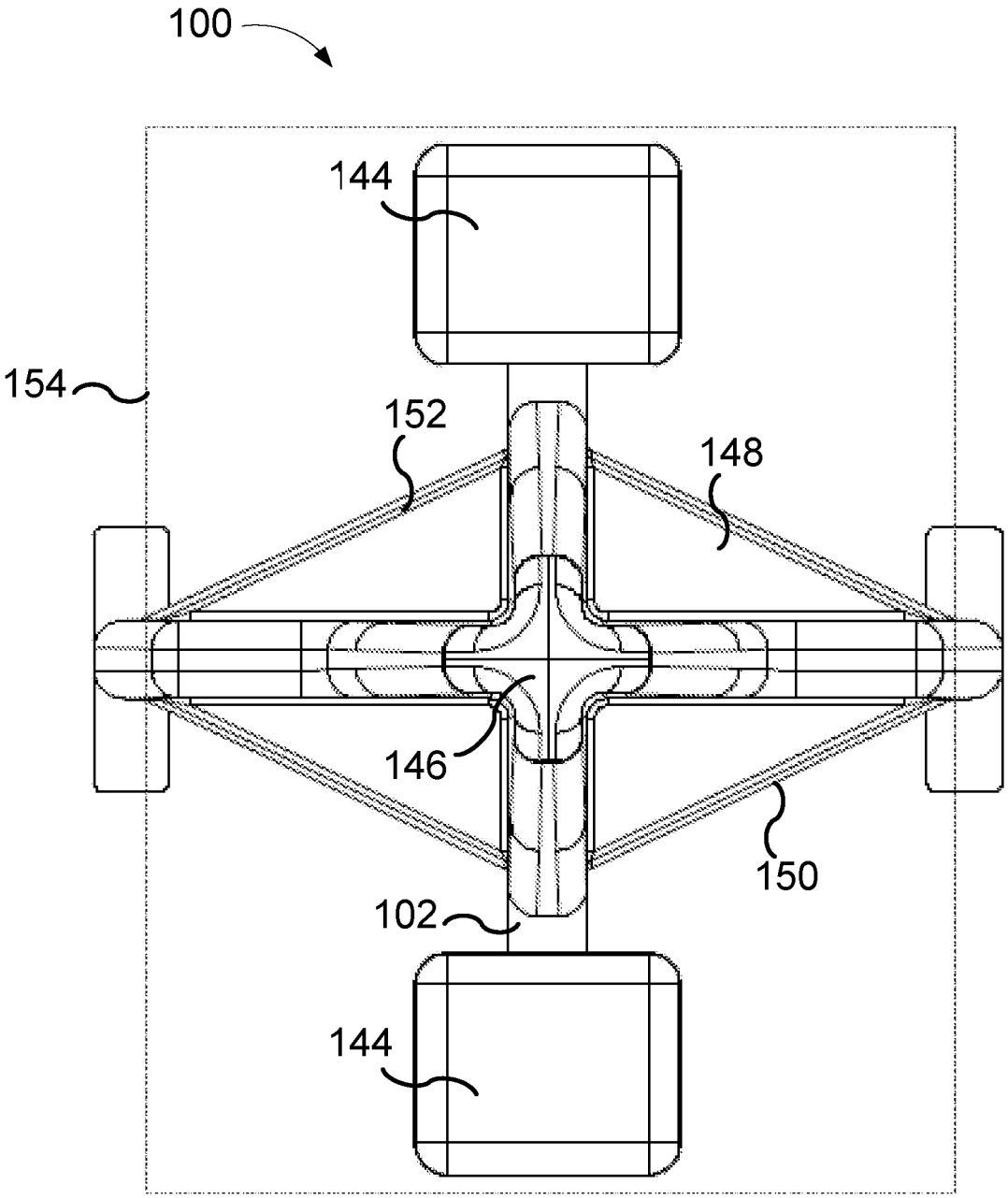
FIG. 1D is a schematic drawing of a rebar clipping apparatus according to some embodiments of the present disclosure.

In some embodiments, clipping apparatus 100 includes a fluid-stop section 148. Fluid-stop section 148 is configured to prevent fluid flow through clipping apparatus 100. In some embodiments, fluid-stop section 148 extends from first base portion 104. In some embodiments, fluid-stop section 148 extends from second base portion 106. In some embodiments, fluid-stop section 148 extends from the intersection of first base portion 104 and second base portion 106. In some embodiments, fluid-stop section 148 extends to first end 108. In some embodiments, fluid-stop section 148 extends to second end 110. In some embodiments, fluid-stop section 148 extends to third end 112. In some embodiments, fluid-stop section 148 extends to fourth end 114. In some embodiments, fluid-stop section 148 includes an outer edge 150 between first base portion 104 and second base portion 106. In some embodiments, fluid-stop section 148 includes a raised rim 152. Referring now to FIG. 1D, together with base 102, platforms 144, and chair 146, fluid-stop section 148 forms an outer surface 154 that limits contact of rebar held in clipping apparatus 100 with fluid.

The clipping apparatus of the present disclosure advantageously allows for easy binding of a plurality of rebar rods and/or wires. The orientation of the base portions and associated extensions and clips consistently orient and hold the rebar in the desired spatial relationship. The extensions stabilize a first rebar rod as a second rebar is applied to the clips. The placement of the clips, platforms, and tapered portions on the base portions make application of the clipping apparatus to rebar an easy process. The chair allows for consistent spacing relative to adjacent planes.

Although the invention has been described and illustrated with respect to exemplary embodiments thereof, it should be understood by those skilled in the art that the foregoing and various other changes, omissions and additions may be made therein and thereto, without parting from the spirit and scope of the present invention. Accordingly, other embodiments are within the scope of the following various embodiments.

What is claimed is:

1. A clipping apparatus for holding rebar, comprising:

a base including a first base portion and a second base portion;

an oblique extension positioned on at least one of said first base portion and said second base portion, said oblique extension defining a notch;

a clip positioned on at least one of said first base portion and said second base portion;

a chair positioned on said base; and a fluid-stop section extending from said first base portion and said second base portion;

wherein said clip includes a first clip arm, an opposing second clip arm, and protruding portions on said first clip arm and said second clip arm, said first and said second clip arms each extend in a first direction away from said base, said protruding portions overlap in that each extends from the clip arms in opposing second and third directions substantially different from said first direction such that said protruding portions and said clip arms define a recess between the protruding portions and said base; and wherein said protruding portions include a tapered end, said tapered ends being configured to guide rebar in a direction parallel to said first direction toward said recess and said base upon application of an engaging force; and wherein said fluid-stop section comprises a surface arranged substantially perpendicular to said first direction.

2. The clipping apparatus according to claim 1, wherein said oblique extension and said clip are disposed at ends of said first base portion and said second base portion.

3. The clipping apparatus according to claim 1, wherein said oblique extension includes a first extension arm and an opposing second extension arm.

4. The clipping apparatus according to claim 1, further comprising a platform adjacent said clip, said platform configured to transmit said engaging force substantially parallel to said clip.

5. The clipping apparatus according to claim 1, wherein said notch includes a notch base and said recess includes a recess base, wherein said notch base and said recess base are non-co-planar.

6. The clipping apparatus according to claim 1, wherein said fluid-stop section includes a raised rim.

7. The clipping apparatus according to claim 1, wherein said fluid-stop section prevents fluid flow through said clipping apparatus.

8. The clipping apparatus according to claim 4, wherein said base, said fluid-stop section, and said chair form an outer surface of said clipping apparatus, wherein said outer surface prevents fluid flow through said clipping apparatus.

9. The clipping apparatus according to claim 1, further comprising a first clip on said first base portion and a second clip on said second base portion.

10. The clipping apparatus according to claim 1, further comprising at least two clips on one of said first base portion and said second base portion.

11. The clipping apparatus according to claim 10, further comprising at least two oblique extensions on one of said first base portion and said second base portion.

12. A clipping apparatus for holding rebar, including:

a base, said base including a first base portion having a first end and a second end and a second base portion having a third end and a fourth end;

a first extension positioned on said first end and a second extension positioned on said second end, each of said extensions defining a notch and extending in a first direction away from said base, said notch being configured to accept rebar upon application of an engaging force in a direction parallel to said first direction;

a first clip positioned on said third end and a second clip positioned on said fourth end, wherein at least one of said first and second clips comprises a first clip arm, an opposing clip arm and protruding portions on said first clip arm and said second clip arm, said first and said second clip arms each extend in the first direction away from said base, said protruding portions overlap in that each extends from the clip arms in opposing second and third directions substantially different from said first direction such that said protruding portions and said clip arms define a recess between the protruding portions and said base;

a chair positioned on said base; and a fluid-stop section connecting said first base portion and said second base portion and comprising an outside edge, and extending from said first base portion, said second base portion, and an intersection of said first base portion and said second base portion, and forming a surface separate from said first and second base portions that is substantially perpendicular to said first direction;

wherein said outside edge of said fluid-stop section extends to at least one of said first end, said second end, said third end, and said fourth end.

13. The apparatus of claim 12, wherein said chair extends from said first base portion and said second base portion.

14. The apparatus of claim 12, further comprising a gap in said second base portion, said gap coaxial with said notches.

15. The apparatus of claim 12, wherein said clips include a recess base, and said protruding portions include at least one protruding portion face positioned to engage rebar with said recess base.

16. The apparatus of claim 12, further comprising platforms adjacent said first clip and said second clip, said platforms configured to transmit an engaging force applied by a user substantially parallel to said clip.

17. The apparatus of claim 12, wherein said outside edge comprises a raised rim.

* * * * *